United States Patent [19]

Musil

[11] Patent Number: 4,482,281

[45] Date of Patent: Nov. 13, 1984

[54] PORTABLE ASPHALT STORAGE SILO

[75] Inventor: Joseph E. Musil, Ely, Iowa

[73] Assignee: Iowa Manufacturing Company of Cedar, Cedar Rapids, Iowa

[21] Appl. No.: 445,913

[22] Filed: Dec. 1, 1982

[51] Int. Cl.[3] ..... B65G 67/08

[52] U.S. Cl. ..... 414/332

[58] Field of Search ..... 414/332, 919; 52/143; 222/160

[56] References Cited

U.S. PATENT DOCUMENTS

| | | | |
|---|---|---|---|
| 2,136,869 | 11/1938 | Spears . | |
| 2,207,303 | 7/1940 | Prout et al. . | |
| 2,310,592 | 2/1943 | Noble . | |
| 3,064,832 | 11/1962 | Heltzel . | |
| 3,141,576 | 7/1964 | Heise . | |
| 3,142,390 | 7/1964 | Freeman . | |
| 3,251,484 | 5/1966 | Hagan . | |
| 3,257,032 | 6/1966 | Stout . | |
| 3,406,839 | 10/1968 | Heltzel . | |
| 3,586,181 | 6/1971 | Brock . | |
| 4,268,208 | 5/1981 | Hankins et al. | 414/332 X |
| 4,337,014 | 6/1982 | Farnham . | |

*Primary Examiner*—Robert G. Sheridan

*Attorney, Agent, or Firm*—Simmons, Perrine, Albright & Ellwood

[57] ABSTRACT

A portable asphalt storage silo includes a wheeled frame carrying a bin and a conveyor. During travel the bin is disposed in a lower position and the conveyor in a horizontal position overlying the bin. Two pairs of struts, a roller serving as a fulcrum, and two winch and cable systems conjointly elevate first the discharge end of the conveyor to an intermediate raised position and then the latter end and the bin to a final elevated position such that material can be carried up from ground level and discharged into the bin for storage.

10 Claims, 6 Drawing Figures

PORTABLE ASPHALT STORAGE SILO

BACKGROUND OF THE INVENTION

Usually asphalt plants include some means of temporarily storing the mix produced by the plant. Typically large, upright storage "silos" are used for that purpose, each silo including a bin elevated so that trucks can drive beneath it for loading. When the plant is a portable, rather than a fixed one, the silo or silos must necessarily accompany it, and that in turn means the bins and the elevators or conveyors needed for filling them must be "knocked down", as it were, for travel and then resurrected at the new location.

There are many existing designs of portable silos for storage of asphalt and kindred products. Some erect the bin and conveyor bodily from a horizontal position in which they are transported, as in U.S. Pat. No. 4,337,014, for instance. Others elevate the bin relative to a bin support structure on a travel frame and then separately place the conveyor in position, as in U.S. Pat. Nos. 2,136,869; 2,207,303; 3,141,576; 3,142,390; 3,217,909; and 3,257,032, for example. Various "batcher" plants jointly elevate the conveyor and bin relative to the travel frame, such as in U.S. Pat. Nos. 2,310,592; 3,064,832; 3,251,484; and 3,406,839. But the bins in these cases are relatively small and are not really for storage in the sense here concerned.

More pertinent to the present invention are asphalt storage silos in which elevation of the bin also elevates the discharge end of the conveyor, the latter and the bin being carried together on a towed travel frame. An example of that approach is disclosed in U.S. Pat. No. 3,586,181. There the bin consists of two telescopic sections, the discharge end of the conveyor being attached to one of the sections. By a series of operations involving both raising and lowering the two bin sections relative to each other and their support structure and detaching and reattaching the discharge end of the conveyor to the bin sections as well as the support structure, the bin and conveyor are elevated to their working position. The disadvantages of this design are the multitude of steps required to elevate (and lower) the components, the need to detach and reattach the conveyor during both movements, and the very elongated travel frame needed to support the inlet end of the conveyor.

A modification of that design, marketed by CMI Corporation of Oklahoma City, Okla., pivots the conveyor intermediate its ends to the bin support structure and positions the conveyor when in its travel position so that it wholly overlies the bin, the latter being no longer of telescopic sections but of integral construction. In the travel position a pair of rear struts are pivotally attached between the inlet end of the conveyor and the rear of the travel frame, and a pair of telescopically adjustable forward struts are pivotally attached between the discharge end of the conveyor and the forward end of the travel frame. For erection the forward struts are first detached from the travel frame. A cable and winch system then tilts the conveyor about its pivot to an intermediate position in which its inlet end is on the ground. The conveyor is then detached from its pivot to the bin support structure and the forward pair of struts adjusted in length and attached to the upper front edge of the bin. A set of four winch and cable systems next elevates the bin and thus the discharge end of the conveyor to their final working position. The need for an elongated travel frame is thereby eliminated but detachment and reattachment of various components is still necessary when raising and lowering the conveyor and bin.

In another current portable asphalt storage silo, manufactured by Astec Industries, of Chattanooga, Tenn., and shown in U.S. Pat. No. 4,348,146, the bin is carried atop an articulated support structure pivoted to the travel frame so that it parallelogrammatically collapses onto the latter for transport. The conveyor is also attached adjacent its discharge end by an articulated linkage to the bin support structure and by a pivot adjacent its inlet end to the travel frame. Hence as the bin support structure is swung upright so is the conveyor. This approach avoids detachment and reattachment of components but requires an elaboration of heavy pivoted components as well as a somewhat elongated travel frame, both to support the inlet end of the conveyor and to accommodate the bin support structure when collapsed.

The chief object of the present invention is therefore to provide a portable asphalt storage silo in which the travel frame is relatively short and the bin and conveyor so interconnected to each other and the travel frame that both can be raised and lowered without the need to attach or detach any components in the process.

SUMMARY OF THE INVENTION

The invention utilizes a relatively short travel frame including an intermediate fixed bin support structure in which the bin can be raised and lowered. The conveyor horizontally overlies the bin during travel, its midpoint or so being supported upon a transverse roller. A rear pair of telescoping struts articulately interconnects the inlet end of a conveyor to the after portion of the travel frame while a forward pair of nontelescoping struts articulately interconnect the upper front edge of the bin and the discharge end of the conveyor.

A first winch and cable system acting between the rear of the travel frame and the rear structs tilts the inlet end of the conveyor downwardly, the roller acting as a fulcrum and at the same time allowing the conveyor to move bodily rearwardly while the forward struts concurrently swing the discharge end of the conveyor upwardly relative to the bin. The conveyor is then in an intermediate elevated position. A second winch and cable system next elevates the bin relative to its support structure, the forward struts at the same time lifting the conveyor off the roller and raising the discharge end of the conveyor still further until its overlies the bin. The silo is thus in final position, ready for use.

Accordingly, the result is a relatively compact and straightforward piece of equipment, the travel frame being appreciably shorter than most and raising and lowering of the bin and conveyor being accomplished without need to detach and reattach various components. Other features and advantages of the invention will become apparent from the drawings and the more detailed description which follows.

DETAILED DESCRIPTION OF THE PREFERRED EMBODIMENT

Figure 2:
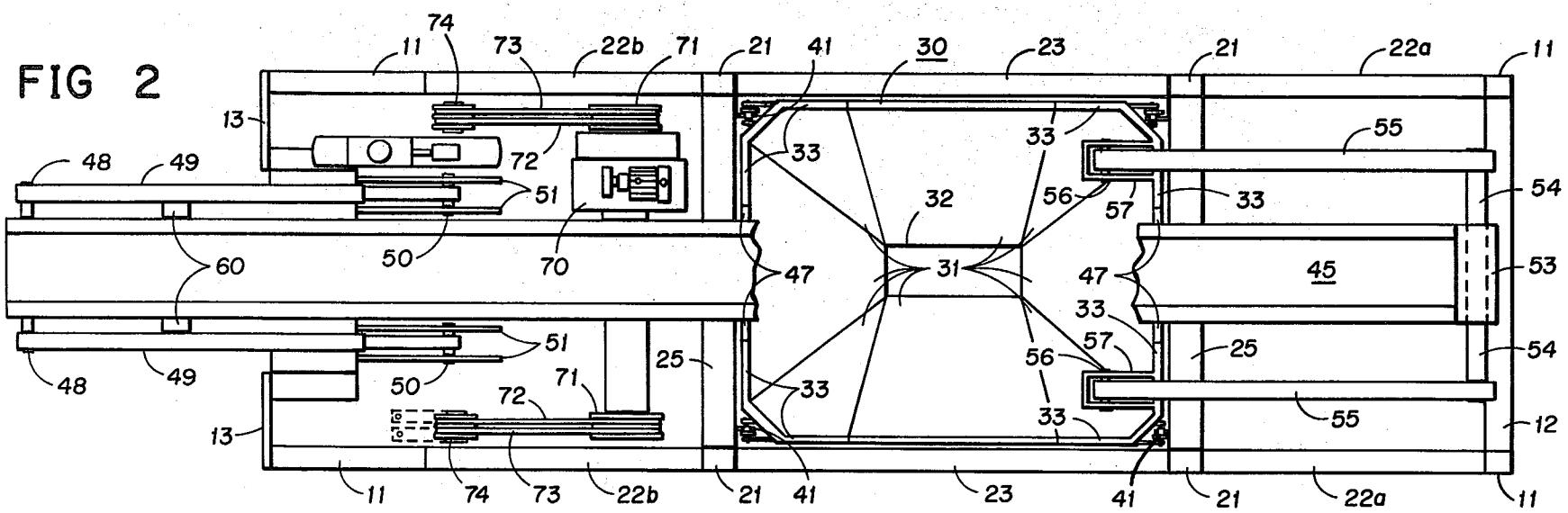
FIG. 2 is a top plan view of the silo of FIG. 1.
Figure 1:
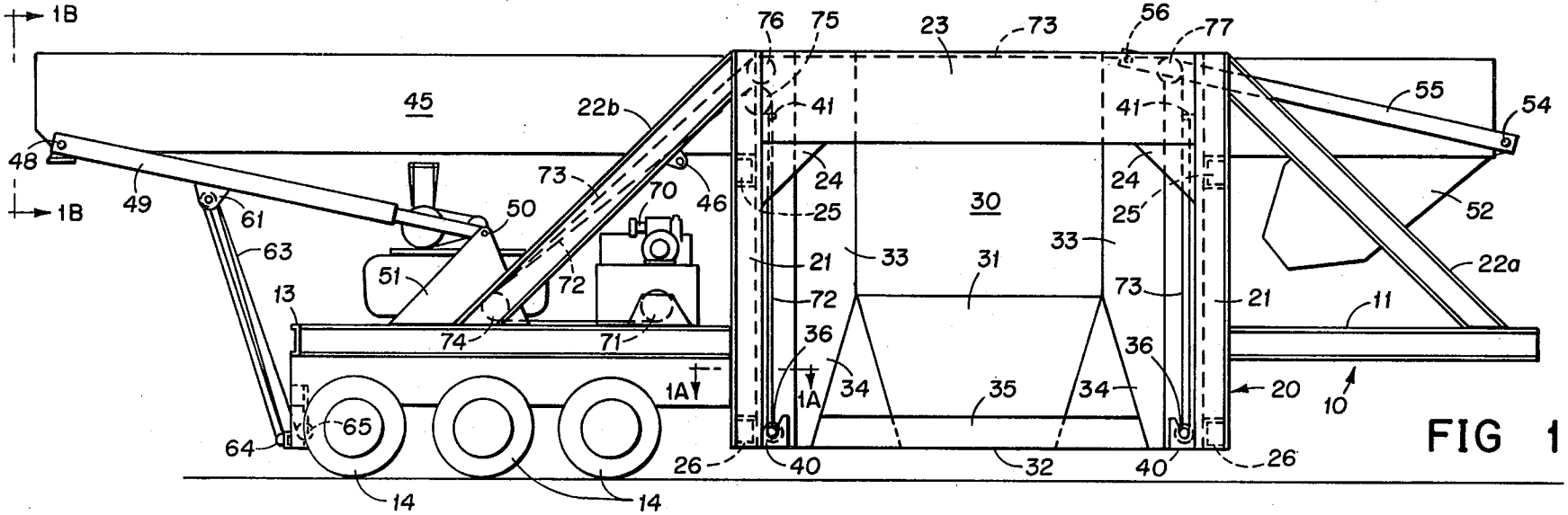
FIG. 1 is a side elevational view of a portable asphalt storage silo according to the invention shown in its travel position.

Referring first to FIGS. 1 and 2, the silo carry frame 10 consists of a rectangular structure, in somewhat trailer like form, welded up of suitable H-beams 11 along its sides, 12 at its forward end and 13 at its after end, all suitably braced. The latter end is supported by several pairs of tandem wheels 14 and the forward end of the frame 10 is equipped for towing. The side beams 11 are interrupted at approximately their midpoints by a fixed, upright bin support structure or base 20 consisting essentially of four uprights 21 welded to their respective side beams 11, their lower ends extending down below the latter beams. The uprights 21 are appropriately braced, the bracing including four diagonal beams 22*a* and 22*b* between the side beams 11 and the top ends of the uprights 21, two deep upper side beams 23, gusseted at 24, and two upper and two lower cross beams 25 and 26, all stiffening the frame 10.

Figures 1A, 1B, 3:
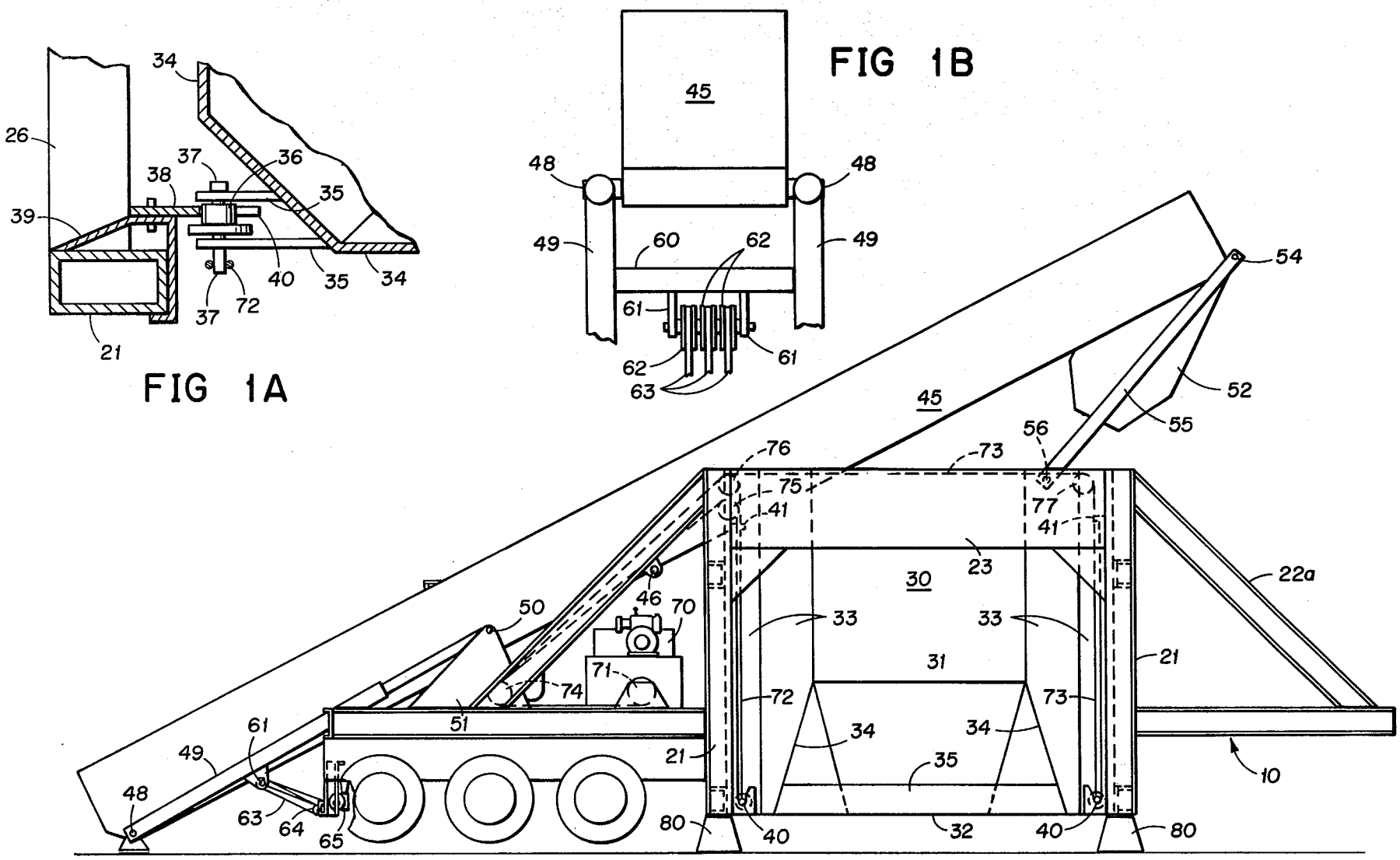
FIG. 1A is a detail sectional view taken along the line 1A—1A of FIG. 1.
FIG. 1B is a detail view taken from the line 1B—1B of FIG. 1.
FIG. 3 is a side elevational view of the silo of FIG. 1 but with the conveyor shown in its intermediate raised position.
Figure 4:
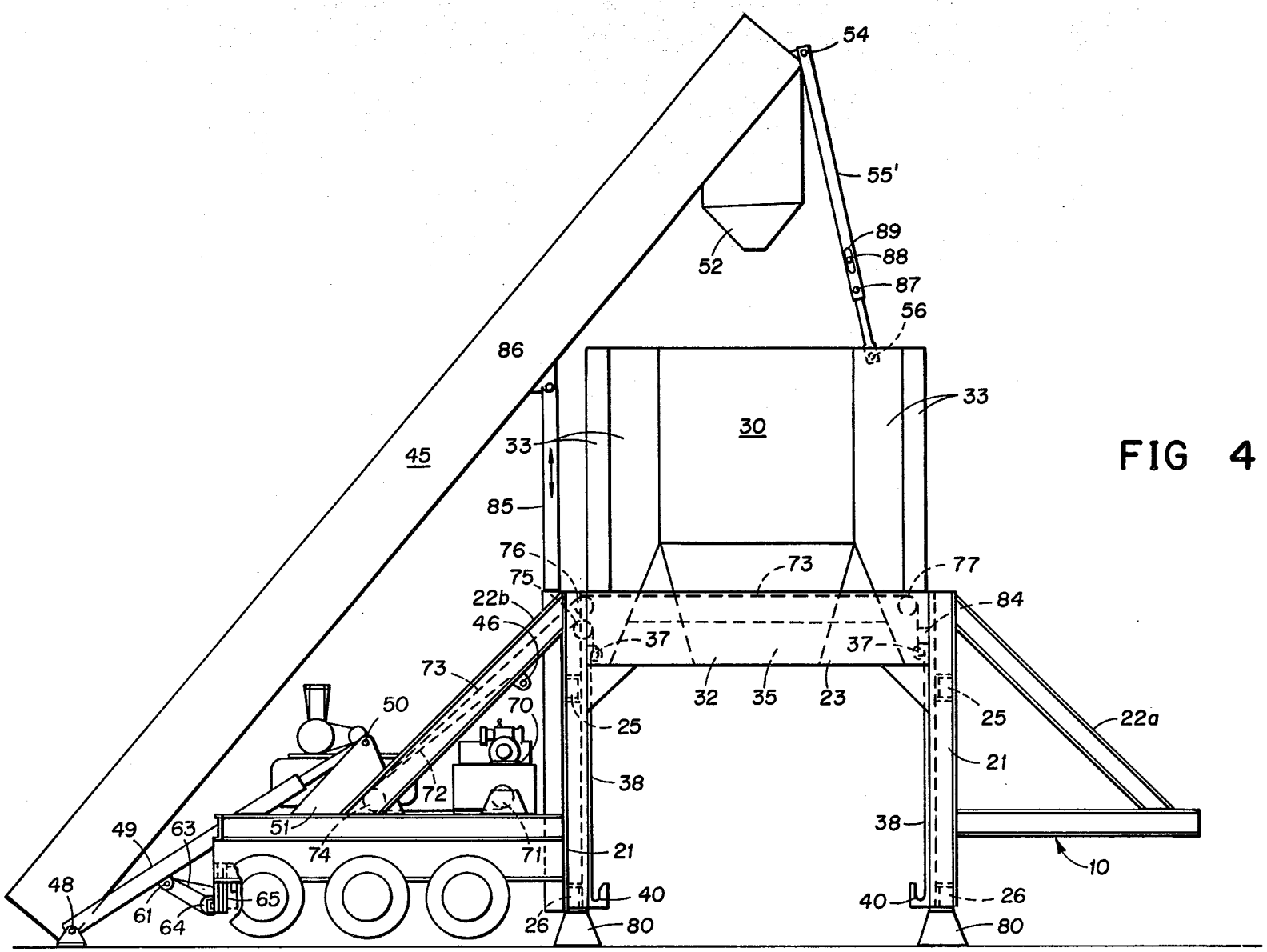
FIG. 4 is a side elevational view of the silo of FIG. 1 but with the bin and conveyor shown in their final raised position ready for use, an optional additional feature being also shown.

Within the base 20 is suspended a generally rectangular bin 30 welded up from shaped flat plates, the lower ones 31 tapering to form a bin discharge opening 32 which is fitted with appropriate gates (not shown). The four corner plates 33 of the bin proper are carried down to form tapered legs 34, their lower ends being interconnected and thus stiffened by a rectangle of four cross beams 35 (only 2 shown in the drawings). The bin 30 is guided within the base 20 by four assemblies, one of which is shown in detail in FIG. 1A, at the lower ends of the legs 34. To the exterior of each leg 34 at its lower end is welded a pair of spaced, fore and aft plates to form a clevis 35 between which a flanged roller 36 is journaled on a heavy pin 37. The roller 36 in turn bears on the edge of an upright guide plate 38 bolted to a formed bracket 39 welded in turn to the adjacent upright 21. The lower end of each guide plate 38 is hooked to provide a seat 40 in which the roller 36 sits when the bin 30 is in its lowermost position, as shown in FIG. 1, thus supporting the bin 30 within the base 20 at that time for travel over the road. The upper end of each guide plate 38 is also hooked to provide a stop 41 for the bin when raised, as shown in FIG. 4.

The conveyor 45, shown in its travel position in FIGS. 1 and 2, lies along the top of the carry frame 10, being supported essentially on the cross beams 25 and a tranverse roller 46 appropriately journaled between the undersides of the rear diagonal beams 22*b*. The forward and rear walls of the bin 30 are provided with U-shaped openings 47 (see FIG. 2) which receive the conveyor 45 and allow it to seat on the cross beams 25. Adjacent the inlet end of the conveyor 45 are pivoted at 48 the rear ends of a pair of telescoping struts 49, the forward ends of the latter being pivoted in turn at 50 between two pairs of large, triangular cleves 51 upstanding from the rear deck of the frame 10. The discharge end of the conveyor 45, which includes a hopper 52, is fitted with a cross sleeve 53 (see FIG. 2) in which is journaled a shaft 54 extending laterally beyond each side of the conveyor 45. To the outer ends of the shaft 54 are fixed the forward ends of a pair of non-telescoping struts 55 whose rear ends in turn are pivoted at 56 in sockets 57 welded adjacent the top of the forward wall of the bin 30.

The struts 49 are joined by a cross member 60 (see FIG. 1B) to which is centrally attached a depending clevis 61 between which are journaled three cable sheaves 62. One end of a first stage cable 63 is anchored to the clevis 61 and passes over the sheaves 62 and a similar set of sheaves 64 mounted to the rear of the frame 10, the other end of the cable 63 being taken up by a powered first stage winch 65 adjacent the sheaves 64. A powered second stage winch 70 is mounted on the rear deck of the frame 10, the winch 70 having two laterally disposed take-up drums 71, one at each side of the frame 10. The ends of two pairs of second stage cables 72 and 73 are anchored to the drums 71, the cables 72 and 73 then passing rearwardly and over two pairs of adjustable cable tensioning sheaves 74. The cables 72 and 73 are thence carried up along side the diagonal braces 22*b* to the top of the base 20. The two cables 72 are entrained over two sheaves 75 (only one being shown) disposed atop the two rear base uprights 21 and then carried down and fixed to the outer ends of the pins 37 of the two rear bin guide rollers 36. The two cables 73 are likewise entrained over sheaves 76 (only one being shown) disposed above the sheaves 75, then carried forward alongside the cross beams 23 to two sheaves 77 (only one being shown) journaled atop the two forward base uprights 21 and finally down and fixed to the outer ends of the pins 37 of the two forward guide rollers 36.

During towing from one location to another the silo is of course in the position shown in FIGS. 1 and 2. When the new site is reached, the frame 10 is detached from the towing vehicle and the silo is bodily elevated by four jacks (not shown) at the lower ends of the base uprights 21 so that foundations 80 can be placed beneath the uprights 21. The first stage winch 65 is then activated so that the cable 63 thereupon pulls the inlet end of the conveyor 45 down to the ground, the latter moving rearwardly on the roller 46 as the rear struts 49 partially collapse and as the forward struts 55 thereby swing the discharge end of the conveyor 45 upwardly. The conveyor 45 is then in its intermediate inclined position shown in FIG. 3. The second stage winch 70 is then activated whereby the cables 72 and 73 raise the bin within its base 20, its movement being controlled by the guide rollers 36 and plates 38, until the rollers 36 contact the stops 41 at the tops of the guide plates 38. At the same time the upward movement of the bin 30 causes the forward struts 55 to elevate the discharge end of the conveyor 45 still further, lifting the latter off the roller 46, until the hopper 52 overlies the bin 30. The silo is then in the position shown in FIG. 4, ready for use, it being understood that the conveyor bin openings 47 are closed by doors (not shown) or other suitable means. To return the silo to its towing position of FIGS. 1 and 2, the foregoing sequence of course is reversed.

Some useful additions may also be incorporated in the silo. For instance, the forward end of the frame 10 may be elongated and a control house mounted on it, the house containing not only the controls for the silo but also all those for the entire asphalt plant of which, of course, the silo is but a part. Hence, the whole plant can be run from that house which thus is also rendered portable without the need for a separate carriage. Likewise, in order to provide a "load out" feature for the silo, four load cells 84 (only one being shown in FIG. 4) may be incorporated between the base uprights 21 and the bin legs 34, operative when the bin 30 is in its working position shown in FIG. 4. Then a hydraulic lift 85 can be mounted to the rear of the base 20. When activated the lift 85 engages a depending knuckle 86 beneath the conveyor 45. The forward struts 55' in this case are also telescopic in nature and include removable pins 87 and fixed pins 88 operative in slots 89 in the female members of the struts 55'. As the lift 85 thereby takes the weight of the conveyor 45 off the struts 55', the pins 87 are removed, the pins 88 allowing the struts 55' thereafter to float in the slots 89, whereby the bin 30 no longer bears the weight of the conveyor 45. Hence the load cells 84, once adjusted for the tare weight of the bin 30, will read directly the weight of the mix in the bin and thereby that dispensed into the trucks below.

Though the invention has been described in terms of a particular embodiment, being the best mode known of carrying out the invention, it is not limited to that embodiment alone. Instead, the following claims are to be read as encompassing all modification and adaptations of the invention falling within their spirit and scope.

I claim:

1. In a portable storage silo for asphaltic concrete including a generally fore and aft extending wheeled framework for over-the-road transport of the apparatus, the framework having an upright bin supporting structure as a part thereof and defining a passageway through which trucks and the like can be driven in a direction transversely of the framework when the silo is in use, an asphaltic storage bin carried by the bin supporting structure, the bin being disposed in said passageway when the silo is being transported but elevatable relative to its supporting structure to an upper position in order to open said passageway when the silo is in use, the bin having an upper end for receiving and a lower end for discharging asphaltic concrete, an elongated conveyor having opposite inlet and outlet ends disposed in a generally fore and aft horizontal position on and carried by the framework when the silo is being transported, the conveyor also overlying the upper bin end, and means for elevating both the bin to its upper position and the conveyor to a final inclined position so that its inlet end is adjacent the ground and its outlet end discharges into the upper bin end, the improvement wherein the elevating means comprises: fulcrum means carried by the framework and partially supporting the conveyor at a location intermediate its ends, the fulcrum means allowing both longitudinal movement of the conveyor in fore and aft directions relative to the framework and tilting movement of the conveyor between its horizontal and final inclined positions; first linkage means interconnecting the framework and the conveyor adjacent its inlet end; second linkage means interconnecting the bin and the conveyor adjacent its outlet end, the first and second linkage means being effective to allow and to control said movements of the conveyor; and power means operatively associated with the conveyor and the bin for elevating the same as aforesaid.

2. The silo of claim 1 wherein the fulcrum means includes a roller having its axis disposed transversely of the framework and engaging the underside of the conveyor when the latter is in its horizontal position, the conveyor remaining engaged with the roller during movement of the conveyor between its horizontal position and an intermediate inclined position, the conveyor being lifted out of engagement with the roller by the second linkage means during movement of the conveyor between its intermediate and final inclined positions.

3. The silo of claim 1 wherein the first linkage means includes a pair of generally fore and aft extending telescoping first struts having their forward ends pivoted to the framework and their after ends pivoted adjacent the conveyor inlet end about transverse axes.

4. The silo of claim 3 wherein the second linkage means includes a pair of generally fore and aft extending non-telescoping second struts having their forward ends pivoted adjacent the conveyor outlet end and their after ends pivoted adjacent the bin upper end about transverse axes.

5. The silo of claim 4 wherein the power means includes winch and cable means operatively effective between respective after portions of the framework and the conveyor and between the bin and the bin supporting structure.

6. The silo of claim 5 wherein the winch and cable means comprise a first winch disposed at the after end of the framework and a first cable system operative between the first winch and the non-telescoping members of the first struts; and a second winch disposed upon the framework adjacent the bin supporting structure and a second cable system operative between the bin supporting structure and the bin, the first winch and cable system being operative to elevate the conveyor from its horizontal to its intermediate inclined position, the second winch and cable system being thereafter operative to elevate the bin to its upper position and in cooperation with the second struts to thereby elevate the conveyor from its intermediate to its final inclined position.

7. The silo of claim 2 wherein the first linkage means includes a pair of generally fore and aft extending telescoping first struts having their forward ends pivoted to the framework and their after ends pivoted adjacent the conveyor inlet end about transverse axes.

8. The silo of claim 7 wherein the second linkage means includes a pair of generally fore and aft extending non-telescoping second struts having their forward ends pivoted adjacent the conveyor outlet end and their after ends pivoted adjacent the bin upper end about transverse axes.

9. The silo of claim 8 wherein the power means includes winch and cable means operatively effective between respective after portions of the framework and the conveyor and between the bin and the bin supporting structure.

10. The silo of claim 9 wherein the winch and cable means comprise a first winch disposed at the after end of the framework and a first cable system operative between the first winch and the non-telescoping members of the first struts; and a second winch disposed upon the framework adjacent the bin supporting structure and a second cable system operative between the bin supporting structure and the bin, the first winch and cable system being operative to elevate the conveyor from its horizontal to its intermediate inclined position, the second winch and cable system being thereafter operative to elevate the bin to its upper position and in cooperation with the second struts to thereby elevate the conveyor from its intermediate to its final inclined position.

* * * * *